US009517389B2

(12) United States Patent
Won

(10) Patent No.: US 9,517,389 B2
(45) Date of Patent: Dec. 13, 2016

(54) BEACH BALL INCLUDING LIGHT-EMITTING DEVICE AND LIGHT-EMITTING DEVICE ACCOMMODATING GROOVE

(71) Applicant: Myung Hee Won, Seoul (KR)

(72) Inventor: Myung Hee Won, Seoul (KR)

( * ) Notice: Subject to any disclaimer, the term of this patent is extended or adjusted under 35 U.S.C. 154(b) by 0 days.

(21) Appl. No.: 14/422,194

(22) PCT Filed: Aug. 6, 2013

(86) PCT No.: PCT/KR2013/007078

§ 371 (c)(1),
(2) Date: Feb. 18, 2015

(87) PCT Pub. No.: WO2014/027784

PCT Pub. Date: Feb. 20, 2014

(65) Prior Publication Data

US 2015/0174459 A1 Jun. 25, 2015

(30) Foreign Application Priority Data

Aug. 14, 2012 (KR) ..... 10-2012-0088681

(51) Int. Cl.

| | |
|---|---|
| ***A63B 43/06*** | (2006.01) |
| ***A63B 41/00*** | (2006.01) |
| ***F21V 33/00*** | (2006.01) |
| ***F21L 4/00*** | (2006.01) |
| ***F21V 3/04*** | (2006.01) |
| ***F21V 23/00*** | (2015.01) |
| *F21W 131/40* | (2006.01) |

(52) U.S. Cl.

CPC ..... *A63B 43/06* (2013.01); *A63B 41/00* (2013.01); *F21L 4/00* (2013.01); *F21V 3/0436* (2013.01); *F21V 23/005* (2013.01); *F21V 33/008* (2013.01); *A63B 2041/005* (2013.01); *A63B 2207/02* (2013.01); *A63B 2243/0095* (2013.01); *F21W 2131/40* (2013.01)

(58) Field of Classification Search

CPC ..... A63B 43/06; A63B 41/00; A63B 2207/02; F21V 33/008; F21L 4/00

See application file for complete search history.

(56) References Cited

U.S. PATENT DOCUMENTS 2,020,484 A * 11/1935 Turner ..... A63B 43/06 362/190
3,229,976 A * 1/1966 Allen, Jr. ..... A63B 43/06 362/158

(Continued)

FOREIGN PATENT DOCUMENTS

KR 10-2002-0097103 A 12/2002
KR 20-0339003 Y1 1/2004

(Continued)

OTHER PUBLICATIONS

International Search Report for PCT/KR2013/007078 mailed Nov. 28, 2013 from Korean Intellectual Property Office.

*Primary Examiner* — Steven Wong

(57) ABSTRACT

The present invention relates to a beach ball including a light-emitting device which can be disposed in the beach ball and a light-emitting device accommodating groove which can removably accommodate the light-emitting device in the ball such that the beach ball can be played with even at night.

2 Claims, 3 Drawing Sheets

(56) References Cited

U.S. PATENT DOCUMENTS 4,776,589 A * 10/1988 Yang ..... A63B 43/06 273/DIG. 5
5,102,131 A * 4/1992 Remington ..... A63B 43/06 428/11
5,236,383 A * 8/1993 Connelly ..... A63B 43/007 446/219
5,375,839 A * 12/1994 Pagani ..... A63B 43/00 446/409
5,564,702 A * 10/1996 Meffert ..... A63F 9/0415 273/153 R
5,609,411 A * 3/1997 Wang ..... F21L 11/00 362/234
5,669,702 A * 9/1997 Wang ..... A63B 43/06 362/234
6,117,030 A * 9/2000 Green, Sr. ..... A63B 43/06 473/570
8,663,040 B2 * 3/2014 Kortegast ..... A63B 43/06 473/570
2004/0162170 A1 * 8/2004 Ng ..... A63B 41/00 473/571
2007/0021244 A1 * 1/2007 Ko ..... A63B 43/06 473/570
2007/0281811 A1 * 12/2007 Wang ..... A63B 43/06 473/570
2011/0136604 A1 * 6/2011 Hsu ..... A63B 43/06 473/609
2013/0023365 A1 * 1/2013 Idoni-Matthews .... A63B 43/00 473/570
2015/0072810 A1 * 3/2015 Kortegast ..... A63B 43/06 473/570
2015/0157900 A1 * 6/2015 Holthouse ..... A63B 24/0021 473/570
2016/0001136 A1 * 1/2016 King ..... A63B 69/0071 320/108

FOREIGN PATENT DOCUMENTS

KR 20-0362526 Y1 9/2004
KR 20-0391062 Y1 7/2005

* cited by examiner (a)

(b)

BEACH BALL INCLUDING LIGHT-EMITTING DEVICE AND LIGHT-EMITTING DEVICE ACCOMMODATING GROOVE

CROSS REFERENCE TO PRIOR APPLICATIONS

This application is a National Stage Patent Application of PCT International Patent Application No. PCT/KR2013/007078 (filed on Aug. 6, 2013) under 35 U.S.C. §371, which claims priority to Korean Patent Application No. 10-2012-0088681 (filed on Aug. 14, 2012), which are all hereby incorporated by reference in their entirety.

TECHNICAL FIELD

The present invention relates to a beach ball having light-emitting devices which can be disposed in the beach ball and light-emitting device accommodating grooves which can removably accommodate the light-emitting devices in the ball so that the beach ball can be played with even at night.

BACKGROUND ART

Usually, when a ball for sports or a ball for pastime is played with outdoors, the ball moves without stop, and thus can be played with only in the daytime in which the movement of the ball can well recognized. Of course, if lighting devices are installed in the sports field or the playground, the ball can be played with even at night; however, the sports field or the playground is difficult to be used for a game other than professional games because cost of equipment or electric charge has to be highly paid. Therefore, a ball has been introduced which has light-emitting means contained therein so that anyone can play with the ball even at night. Namely, in Korean Registered Utility Model No. 0391062, a light-emitting beach ball is disclosed wherein a light-emitting ball (15) capable of emitting a light of LED and also sound is contained in a body (11), which light-emitting ball includes a circuit board with a shock-detecting sensor, sound-generating device, a battery etc. mounted thereon, and a small ball moves within the body (11) along an inner wall of globular space within the beach ball body when the beach ball (10) is played with; however, detailed structure of it is not described.

Furthermore, in Korean Registered Utility Model No. 0339003, a lighting beach ball is disclosed wherein a lighting body insertion port (8) is formed opposite to an air injection port (4), a light-transmissive tube (12) is installed for connecting an air injection hole (5) and a lighting body insertion hole (9) and the light-transmissive tube (12) is provided with a lighting body-housing part (18) for housing a lighting body (16); however, the lighting beach ball has a problem that its structure is very complicated and production cost is very high. Meanwhile, in Korean Registered Utility Model No. 0362526, a ball with light-emitting parts is disclosed wherein a plurality of through-holes are formed in a transparent outer skin and inner skin is provided having a plurality of groove portions coupled inside the plurality of through-holes and the light-emitting parts are inserted in the groove portions of the inner skin; however, the ball also has a problem that its structure of the emitting parts is very complicated and production cost is very high.

SUMMARY OF THE INVENTION

Technical Problems

Therefore, in order that a ball (hereinafter, referred to as "beach ball") can be played with even at night which is inflated into a globular form by blowing of air into the ball through air injection port when playing with a ball of simple structure having only outer skin made of soft synthetic resin like the beach ball and which can be collapsed by withdrawing of the air through the air injection port when storing the ball after the end of the play, it is necessary to develop a beach ball which has light-emitting devices having a structure allowing the light-emitting devices to be easily removably disposed in the beach ball and light-emitting device accommodating grooves capable of accommodating the light-emitting devices.

Solution to the Problem

The present invention was made in order to solve the above-mentioned problem, and the problem can be solved by developing a light-emitting device which has LED as a light source and a mercury cell as an electric source and is suitable for installation and use in the beach ball and by forming a light-emitting device groove integrally with the beach ball, which groove allows the light-emitting device to be easily installed in the beach ball and withdrawn therefrom.

Effects of the Invention

At normal times air is injected into the beach ball and then the ball is played with, and at night, the light-emitting device including only the LED, mercury cell and electric wires for connecting the former two components has only to be installed in the light-emitting device groove formed in the beach ball, therefore, the ball can be played with outdoors such as on the beach, in a field and the like even at night.

BEST MODES FOR CARRYING OUT THE INVENTION

The present invention relates to a beach ball including light-emitting devices which can be disposed in the beach ball and light-emitting device accommodating grooves which can removably accommodate the light-emitting devices in the ball so that the beach ball can be played with even at night, the light-emitting device accommodating grooves being formed integrally with the ball.

Hereinafter, the present invention will be described in detail with reference to the attached drawings.

Figure 1:
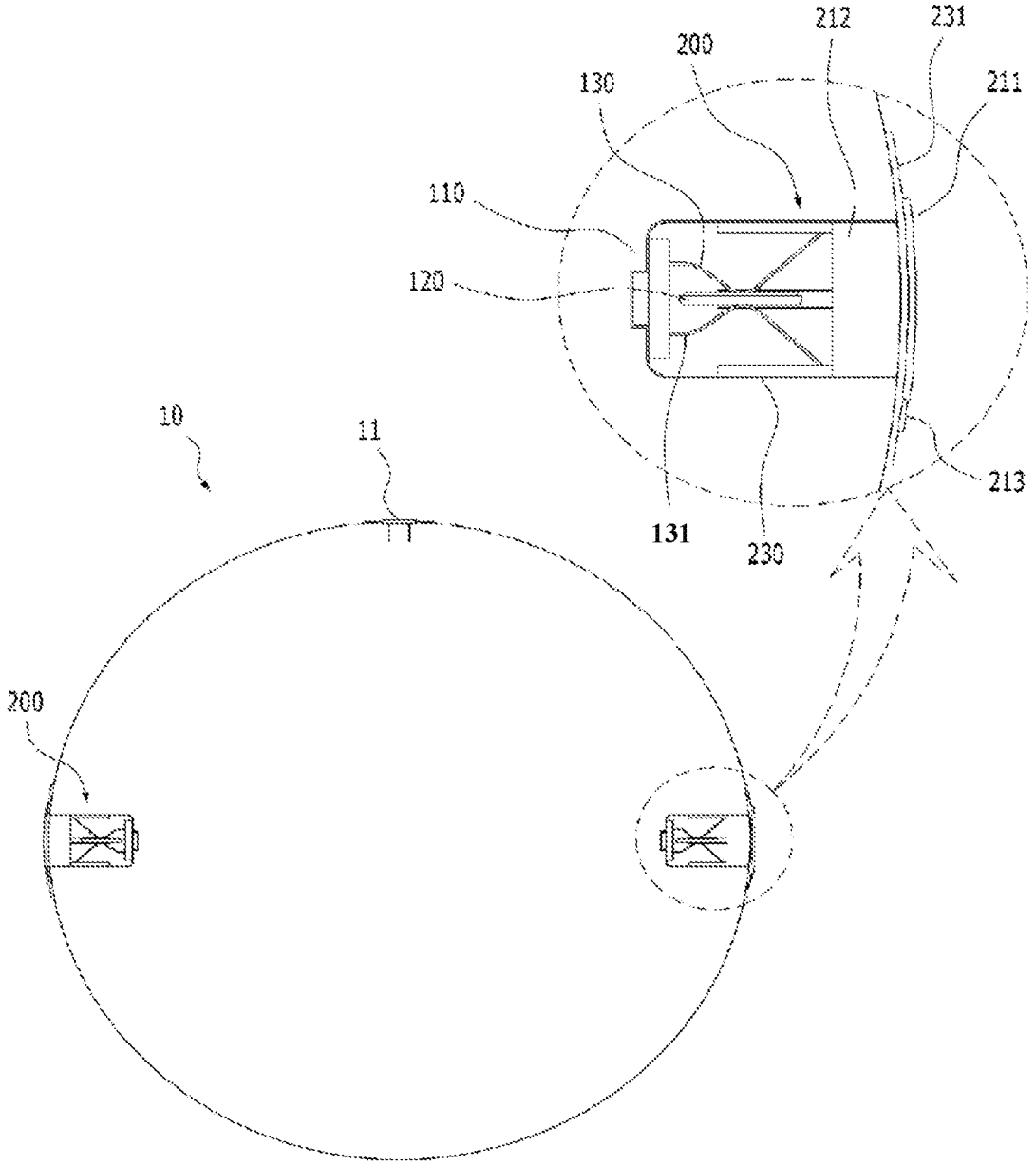
FIG. 1 is a perspective and internal see-through view of a beach ball of the present invention.
Figure 2:
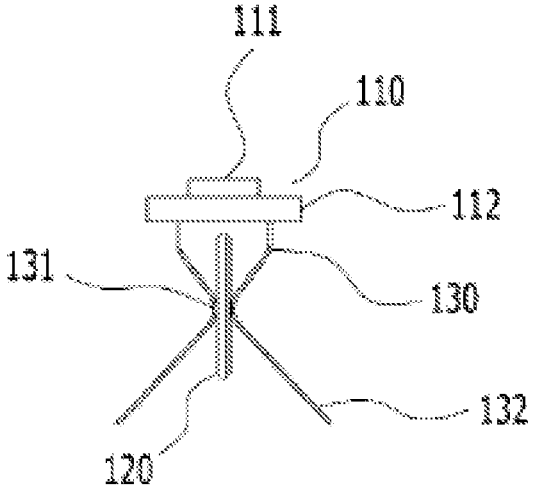
FIG. 2 is a view illustrating a light-emitting device of the present invention, wherein (a) is a front view of the light-emitting device of the present invention and (b) is a perspective view of the light-emitting device of the present invention.
Figure 2:
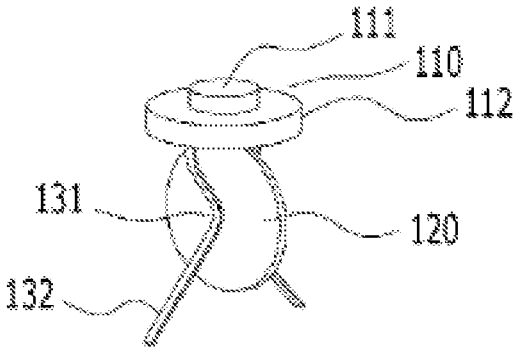
Figure 3:
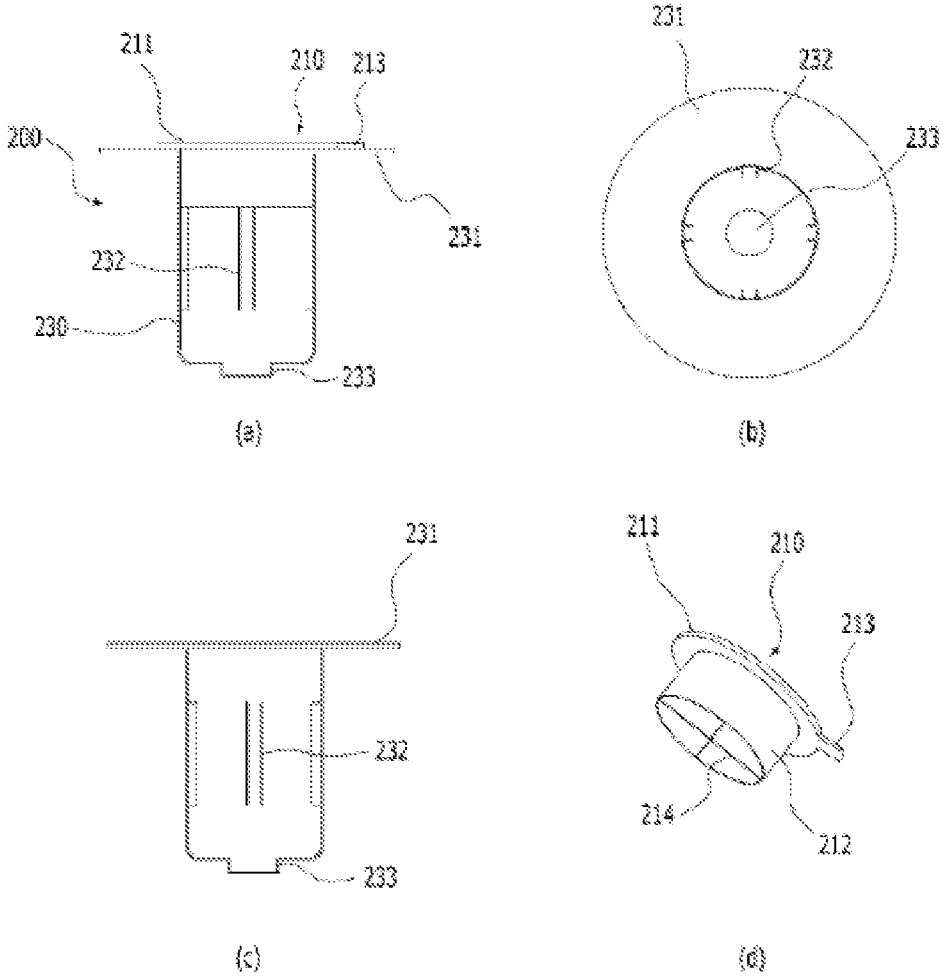
FIG. 3 is a view illustrating a light-emitting device accommodating groove of the present invention, wherein (a) is a front view of the light-emitting device accommodating groove of the present invention, (b) is a front view of a body of the light-emitting device accommodating groove of the present invention, (c) is a plane view of the body of the light-emitting device accommodating groove of the present invention, and (d) is a perspective view of a cover of the light-emitting device accommodating groove of the present invention.

FIG. 1 is a perspective and internal see-through view of a beach ball of the present invention, FIG. 2 is a view illustrating a light-emitting device of the present invention, FIG. 2(*a*) is a front view of the light-emitting device of the present invention and FIG. 2(*b*) is a perspective view of the light-emitting device of the present invention, FIG. 3 is a view illustrating a light-emitting device accommodating groove of the present invention, FIG. 3(*a*) is a front view of the light-emitting device accommodating groove of the present invention, FIG. 3(*b*) is a front view of a body of the light-emitting device accommodating groove of the present invention, and FIG. 3(*c*) is a plane view of the body of the light-emitting device accommodating groove of the present invention, and FIG. 3(*d*) is a perspective view of a cover of the light-emitting device accommodating groove of the present invention.

As shown in FIG. 1, a known air injection port (11) capable of injecting and withdrawing air is formed in the beach ball (10) of the present invention, and two to five or more light-emitting device accommodating grooves (200) capable of storing the light-emitting device (100) are formed in an outer circumferential surface of the beach ball (10).

An outer skin of the beach ball (10) used in the present invention is made of PVC material with a thickness from 0.05 to 0.5 mm like material for an ordinary beach ball sold in the market. As the material, one may be used which has white color and black color mixed or deep color and bright color mixed; however, it is preferable to use a material having only white color or only bright color, considering that the present invention is intended to allow the beach ball to be played with even at night. In any case, when the light-emitting device (100) is contained in the ball and is lighted, the beach ball (10) emits light brightly like the full moon and thus is well seen even at night.

As shown in FIG. 2, the light-emitting device (100) used in the beach ball (10) of the present invention includes a light source (110) which emits light, an electric source (120) which accumulates electricity, and electric wires (130) which supply the light source (110) with the electricity of the electric source (120).

As the light source (110), one LED is used per one light-emitting device (100), which LED emits bright light with less consumption of electricity. More particularly, after the LED and PCB board sold in the market are purchased, the PCB board is cut to a minimum size so that it can accommodate only one LED, and then one LED (111) is adhered to one PCB board (112) thus cut. Even when two to five, preferably only two light-emitting devices (100) are installed in the beach ball, the beach ball (10) can emit light brightly like the full moon, so that no inconvenience is caused to playing with the ball at a black night.

If only one light-emitting device (100) is installed, light is biased to one side, thereby causing unbalance. To position one light-emitting device (100) at a center of the ball, a lot of auxiliary devices such as lines for supporting the light-emitting device are required. In addition, if six or more light-emitting devices (100) are installed, light is too bright, which is wasteful.

As the electric source (120), a 3-V subminiature mercury cell is used which has a light weight and a long service life and is convenient to carry.

As shown in FIG. 2, two elastic thin steel wires are used as the electric wires (130), upper portions of the electric wires (130) are attached to the underside of the PCB board (112), and electric source connection portions (131) are formed by narrowly bending middle portions of the electric wire (130) inwards so that the middle portions can tightly pinch a body of the electric source (120) from both sides, whereby the electric source connection portions can accommodate the electric source (120). Although there are several ways of attaching the electric wires (130) to the underside of the PCB board (112), soldering is simple and easy.

Meanwhile, since the electric source connection portions (131) of the electric wires (130) tightly pinch the body of the electric source (120) from both sides and thus the electric source (120) and the electric wires (130) are connected with each other, and thus one of the electric wires becomes a positive (+) electrode and the other becomes a negative (−) electrode, whereby the electricity is supplied to the light source (110) and thus the light source (110) is lighted.

At the same time, electric wire support portions (132) are formed by spreading both end portions of the electric wires (130) outwards so that the end portions can contact with an inner wall of a main body (230) of the light-emitting device accommodating groove (200). Therefore, when the light-emitting device (100) is inserted in the main body, the electric source (120) and the electric wire support portions (132) are positioned while being tightly caught within the main body (230) on four sides, whereby the light-emitting device (100) is stably positioned within the main body (230).

The light-emitting device accommodating groove (200) is produced from transparent or translucent soft synthetic resin or rubber and is an elastic cylindrical body with a closed bottom. Two to five light-emitting device accommodating grooves are formed in the outer circumferential surface of the beach ball (10), and each groove includes a cover (210) and the main body (230).

The cover (210) includes a lid (211) and a body (212) integrally formed with each other.

The lid (211) is intended to cover the light-emitting device accommodating groove (200) so that the light-emitting device (100) is not withdrawn after the light-emitting device (100) is inserted into the light-emitting device accommodating groove (200) or to cover the light-emitting device accommodating groove (200) and thus prevent exposure of holes in the outer circumferential surface of the beach ball (10) also after the light-emitting device (100) is withdrawn.

The body (212) is in the form of a hollow cylinder inserted into the main body (230), and its outer diameter is similar to the inner diameter of the main body (230) and its length is 20 to 30% of the length of the main body (230), whereby the body (212) is forcedly fitted deeply into the main body (230) to block an inlet of the main body (230), and once fitted, is not easily withdrawn without forcible extraction.

Since the body (212) is hollow, it is worried that the body may be buckled when it is forcedly fitted into the main body (230). Therefore, "1"- or "+"-shaped partition wall is formed within the body (212) to increase supporting capability.

Therefore, since the body (212) is tightly fitted in the main body (230) so that the cover (210) is not opened and the body (212) is inserted to 20 to 30% of the depth of the main body (230) from above the main body, once the cover (210) is closed, the cover (210) is not withdrawn even if the ball is intensively played with when the cover (210) is closed.

Meanwhile, since the cover (210) has to be frequently opened and closed whenever the light-emitting device (100) is introduced into and withdrawn from the light-emitting device accommodating groove (200), it is preferred that a handle (213) is formed on the lid in order to further facilitate the opening and closing of the cover (210).

On the top of the main body (230), a flange (231) is formed extending from an outer circumferential surface of the main body (230), and supporting means (232) are formed on an inner wall of middle part of the main body, and a light source accommodating groove (233) is formed at a lower end of the main body.

The flange (231) is integrally adhered to the outer circumferential surface of the beach ball (10) like the air injection port (11) when the beach ball (10) of the present invention is produced. Therefore, the main body (230) can be integrally formed within the beach ball (10).

The inner diameter of the main body (230) is the same as the diameter of the electric source (120), and four supporting means (232) for supporting the electric source (120) and the electric wires (130) are formed at equal intervals on the inner wall of the main body. Even though the diameter of the main body (230) is the same as the diameter of the electric source (120), the electric source (120) can be accommodated with no problem since the main body (230) is produced from the soft synthetic resin to have an elasticity; rather, the electric source (120) is tightly fitted in the main body (230) due to the elasticity of the main body (230).

The supporting means (232) may be formed by thin elongate groove having such a width that an outer circumferential surface of the electric source (120) and the electric wires (130) can be inserted in the groove, or by two elongate protruding lines formed with such a narrow spacing that the outer circumferential surface of the electric source (120) and the electric wires (130) can be inserted between the two lines as shown in FIG. 3.

Of the four supporting means (232), one pair facing each other are intended to support the electric source (120) and the other pair facing each other are intended to support the electric wires (130).

In any case, the electric source (120) is fixed by being inserted in or supported by any pair of the supporting means (232), and supply lines for the electric source (120) are fixed by being inserted in or supported by the other pair of the supporting means (232). For example, when the supporting means (232) is formed by the two protruding lines, the outer circumferential surface of the electric source (120) and the electric wire supporting portions (132) are positioned between the two protruding lines; therefore, the light source (110) and the electric source (120) are all fixed by the supporting means (232) and thus are not deviated even if the ball is intensively played with.

The light source (110) is lighted when the electric wires (130) are connected to the electric source (120), and when the light-emitting device (100) is accommodated in the light-emitting device accommodating groove (200), the light source (110) emits light while being accommodated in the light source accommodating groove (233) formed at the end of the main body (230), thereby brightly lighting the inside of the beach ball (10).

Hereinafter, operation of the present invention will be described.

The light-emitting device (100) does not need to be used in the daytime, and thus the ball is played with while the light-emitting device (100) is not installed. At this time, air is injected into the ball and then the ball is played with in a state where the light-emitting device accommodating groove (200) is closed by the cover (210), since the light-emitting device accommodating groove (200) is integrally formed inside the outer circumferential surface of the beach ball (10).

Meanwhile, for playing with the ball even at night, the light-emitting device (100) has to be installed in the beach ball (10) as the ball is not well seen at night. Therefore, first, the air injection port (11) is opened and then the air is injected into the beach ball (10) to make the ball globular. Subsequently, the light source (110) and the electric source (120) are connected by connection portions for the electric source (120) and thus light-emitting device (100) is lighted, thereafter, the light-emitting device (100) is accommodated in the light-emitting device accommodating groove (200). At this time, since the inner diameter of the main body (230) is the same as the diameter of the electric source (120) and the main body (230) is elastic, the electric source (120) and the connection portions for the electric source (120) are each supported by the supporting means (232), whereby the light-emitting device (100) is immobilized and fixed. Subsequently, the main body (230) is closed by the cover (210).

Meanwhile, since the light source (110) accommodated in the light-emitting device accommodating groove (200) is lighted, the beach ball (10) is brightly lighted like the full moon and thus the ball can be also played with in a dark place such as on the beach or the riverside or outdoors even at night without any inconvenience.

Although the beach ball has been described as above, of course, the technical concepts of the present invention and the scope of claims thereof cover a rubber ball or other ball having a structure similar to the beach ball.

What is claimed is:

1. A beach ball formed with a known air injection port and having light-emitting devices and light-emitting device accommodating grooves so that the beach ball can be played with even at night, wherein each of the light-emitting devices comprises:

a light source formed by cutting a PCB board to a minimum size for accommodation of only one LED and thereafter adhering one LED to each one PCB board thus cut;

an electric source comprising a subminiature 3-V mercury cell; and electric wires which are two elastic thin steel wires, upper portions of which are attached to the underside of the PCB board, and which supply the light source with electricity of the electric source, wherein the electric wires comprise:

electric source connection portions formed by narrowly bending middle portions of the steel wire inwards so that the middle portions can accommodate the electric source; and electric wire support portions formed by spreading both end portions of the electric wires outwards so that the end portions can contact with an inner wall of a main body of the light-emitting device accommodating groove.

2. A beach ball formed with a known air injection port and having light-emitting devices and light-emitting device accommodating grooves so that the beach ball can be played with even at night, wherein each of the light-emitting device accommodating grooves comprises:

a cover which is produced from transparent or translucent soft synthetic resin or rubber and which has a lid for covering the light-emitting device accommodating groove so that the light-emitting device is not withdrawn after insertion of the light-emitting device into the light-emitting device accommodating groove or for covering the light-emitting device accommodating groove and thus preventing exposure of holes in an outer circumferential surface of the beach ball also after the light-emitting device is withdrawn; and a body which is in the form of a hollow cylinder inserted into a main body, wherein the outer diameter of the body is similar to the inner diameter of the main body and the length of the body is 20 to 30% of the length of the main body, and thus the body is forcedly fitted deeply into the main body to block an inlet of the main body; and two to five main bodies which are elastic cylindrical body having a closed bottom and produced from transparent or translucent soft synthetic resin or rubber and which are formed integrally with the beach ball, wherein, on the top of each main body, a flange is formed extending from an outer circumferential surface of the main body, and four pairs of supporting means are formed on an inner wall of middle part of the main body at equal intervals, and a light source accommodating groove for accommodating the light source is formed at a lower end of the main body, wherein the supporting means is an elongate long groove with such a width that an outer circumferential surface of the electric source and the electric wires can be inserted in the groove or is two elongate protruding lines formed with such a narrow spacing of the width, and the outer circumferential surface of the electric source and electric wire support portions are positioned in the groove or between the two protruding lines and thus are not deviated.

* * * * *